US011185184B2

(12) United States Patent
Andersen

(10) Patent No.: US 11,185,184 B2
(45) Date of Patent: Nov. 30, 2021

(54) ORNAMENT DISPLAY HANGER

(71) Applicant: Marcia Andersen, Wynantskill, NY (US)

(72) Inventor: Marcia Andersen, Wynantskill, NY (US)

( * ) Notice: Subject to any disclaimer, the term of this patent is extended or adjusted under 35 U.S.C. 154(b) by 149 days.

(21) Appl. No.: 16/565,856

(22) Filed: Sep. 10, 2019

(65) Prior Publication Data

US 2020/0077827 A1 Mar. 12, 2020

Related U.S. Application Data

(60) Provisional application No. 62/729,776, filed on Sep. 11, 2018.

(51) Int. Cl.
*A47G 33/10* (2006.01)
*A47G 33/08* (2006.01)

(52) U.S. Cl.
CPC ..... *A47G 33/10* (2013.01); *A47G 33/0818* (2013.01); *A47G 2033/0827* (2013.01)

(58) Field of Classification Search
CPC ..... A47G 33/10
See application file for complete search history.

(56) References Cited

U.S. PATENT DOCUMENTS 1,406,007 A 2/1922 Hanson
1,640,497 A 8/1927 Halket et al.
2,526,810 A 10/1950 Newell
3,131,449 A 5/1964 Chiyoichi
4,169,549 A * 10/1979 Takagi ..... A47G 25/483 223/96
4,266,677 A 5/1981 Dewsnap
4,308,981 A 1/1982 Miura
D274,590 S 7/1984 Miura
4,535,513 A 8/1985 Sterle
D297,285 S 8/1988 Larsson
5,383,638 A 1/1995 Dieringer et al.
6,416,028 B1 7/2002 Miller et al.
6,854,609 B1 2/2005 Hettinger
6,921,561 B1 * 7/2005 Maier ..... A47G 33/08 24/343

(Continued)

*Primary Examiner* — Mark Ruthkosky
*Assistant Examiner* — Julia L Rummel
(74) *Attorney, Agent, or Firm* — Schmeiser, Olsen & Watts, LLP

(57) ABSTRACT

An ornament display hanger including a clamp having a first clamping member, a second clamping member, and a connector attached to the first clamping member and second clamping member such that the connector is located between the first clamping member and second clamping member. The connector includes at least one hole. The first clamping member and second clamping member are moveable about the connector. A hook is disposed through the at least one hole. The hook includes a securable attachment portion configured to receive a decoration such that the decoration hangs from the hook. The hook is rotatable 360 degrees within the hole such that rotation of the hook rotates the decoration. An ornament display hanger kit comprises at least one ornament display hanger. A method of making an ornament display hanger includes attaching a first clamping member and a second clamping member to a connector.

14 Claims, 9 Drawing Sheets

(56) References Cited

U.S. PATENT DOCUMENTS

| | | | | |
|---|---|---|---|---|
| 7,717,388 | B2 | 5/2010 | Rizzo | |
| 7,996,963 | B2 | 8/2011 | Cameron | |
| 9,677,219 | B2 | 6/2017 | Woodson | |
| 2004/0056162 | A1 | 3/2004 | Cole | |
| 2019/0159622 | A1* | 5/2019 | Miner | A47G 33/10 |
| 2019/0316743 | A1* | 10/2019 | Planinsek | F21V 21/088 |

* cited by examiner

ORNAMENT DISPLAY HANGER

FIELD OF TECHNOLOGY

The subject matter disclosed herein relates generally to decoration hangers. More particularly, the present disclosure concerns a clamping hanger for displaying any part of an ornament.

BACKGROUND

People often decorate their homes with ornaments or other decorations during holidays. For example, many decorate trees with ornaments. Ornaments are often hung with string loops or hooks by placing a string loop or hook attached to an ornament over a tree branch. Where the tree branch to be decorated is of a coniferous tree, such as a pine tree, the needles on the branch can make it difficult to place a string loop of an ornament or a hook over the branch because the string loop and hook can get caught on the needles. Further difficulty can arise in using string loops and hooks to hang ornaments because rigidity of certain branch needles can scratch a person's hands and arms as they reach into the branches of the tree to hang an ornament. Often, it is necessary to use both hands to physically manipulate a tree branch to hang an ornament thereon when using a string loop or hook, which can increase the likelihood and severity of skin abrasions. Using a string loop or hook to hang an ornament also limits a person's ability to display a certain face or part of an ornament because the configuration of a string loop or hook can result in an ornament only being able to hang in a certain position. This prevents a person from displaying the entirety of an ornament, or displaying a desired part of the ornament, particularly in instances where an ornament has an image or phrase or other decorative aspect that is only visible on one side or portion of an ornament.

Accordingly, a need exists for an ornament display hanger that can easily attach to a tree branch or other location and that permits all or a particular portion of an ornament to be displayed.

SUMMARY

A first aspect generally relates to an ornament display hanger comprising a clamp including: a first clamping member having a first top portion and a first bottom portion; a second clamping member having a second top portion and a second bottom portion; and a connector attached to the first clamping member and second clamping member such that the connector is located between the first clamping member and second clamping member, the connector including at least one hole extending through the connector, wherein the first clamping member and second clamping member are moveable about the connector such that in a first position the first top portion and second top portion provide a clamping force, and such that in a second position the first bottom portion and second bottom portion are separated by the first bottom portion and second bottom portion being pressed towards each other; and a hook disposed through the at least one hole, wherein the hook includes a securable attachment portion configured to receive a decoration such that the decoration hangs from the hook, wherein the hook is rotatable 360 degrees within the hole such that rotation of the hook rotates the decoration.

A second aspect generally relates to an ornament display hanger kit comprising at least one clamp, the at least one clamp comprising a first clamping member having a first top portion and a first bottom portion and a second clamping member having a second top portion and a second bottom portion; at least one connector configured to attach to the first clamping member and second clamping member such that the connector is located between the first clamping member and second clamping member, and such that the first clamping member and second clamping member are moveable about the connector, wherein in a first position the first top portion and second top portion provide a clamping force, wherein in a second position the first bottom portion and second bottom portion are separated by the first bottom portion and second bottom portion being pressed towards each other, wherein the connector includes at least one hole extending through the connector; and at least one hook configured to be disposed through the hole, wherein the at least one hook includes a securable attachment portion configured to receive a decoration such that the decoration hangs from the hook, wherein the at least one hook is configured to rotate 360 degrees within the hole such that rotation of the at least one hook rotates the decoration.

A third aspect generally relates to a method of making an ornament display hanger, the method comprising: attaching a first clamping member and a second clamping member to a connector such that the connector is located between the first clamping member and second clamping member and the first clamping member and second clamping member are moveable about the connector such that in a first closed position the first top portion and second top portion provide a clamping force, and such that in a second position the first bottom portion and second bottom portion are separated by the first bottom portion and second bottom portion being pressed towards each other; and inserting a hook through a hole in the connector such that the hook is rotatable 360 degrees within the hole.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

Figure 1A:
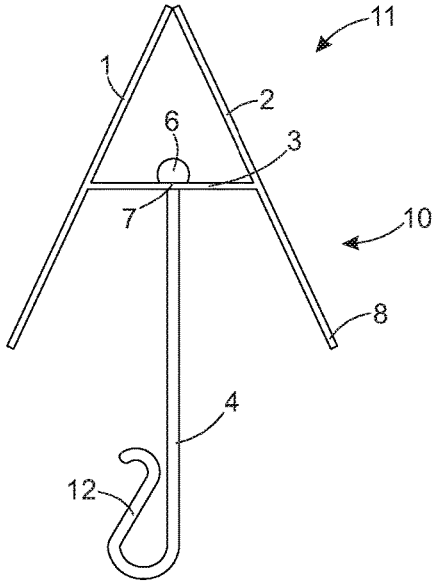
FIG. 1A depicts a front view of an ornament display hanger according to one embodiment.

Embodiments of the present invention can be modified in various forms, and the scope of embodiments of the present invention should not be construed as being limited to embodiments described below. The embodiments are provided to fully describe embodiments of the present invention to those of ordinary skill in the art. Therefore, in the drawings, shapes of components and the like are exaggerated for clarity of description.

Figure 1B:
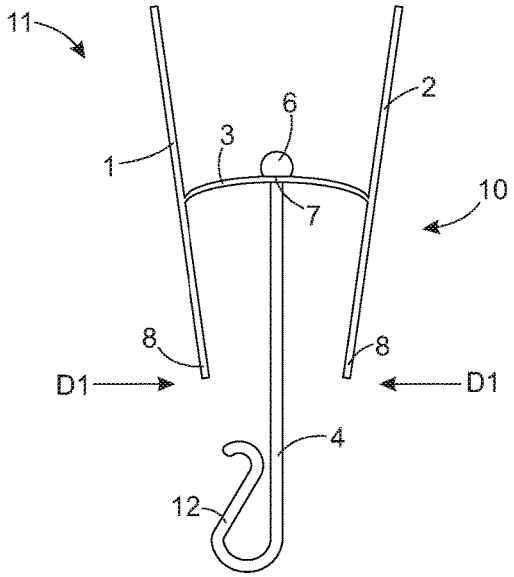
FIG. 1B depicts a front view of the ornament display hanger according to the embodiment shown in FIG. 1A, wherein the ornament display hanger is in an open position.

Referring to FIG. 1A, a front view of an ornament display hanger 11 is shown. The ornament display hanger has a hook 4 and a clamp 10. The hook 4 has a securable attachment portion 12. The clamp 10 has a first clamping member 1 and a second clamping member 2. The first clamping member 1 and the second clamping member each have a bottom portion 8 and a top portion 9. Extending between the first clamping member 1 and the second clamping member 2 is a connector 3. The first clamping member 1 and the second clamping member 2 are moveable about the connector 3 such that the top portions 9 of the first and second clamping members 1, 2 open and close. For example, the first clamping member 1 and second clamping member 2 are configured to provide a clamping force when the top portions 9 are closed together as shown in FIG. 1A, and the first clamping member 1 and second clamping member 2 are configured to be moved into an open position in which the top portions 9 are apart from each other, as shown in FIG. 1B. The connector 3 may be a tension member configured to provide the clamping force of the top portions. The connector 3 may be a horizontal member, a bar, and the like. In another embodiment, the clamping force of the top portions may be provided by a spring or other releasably compressable member, located above or below the connector 3. The clamp 10 may be opened by pressing the bottoms 8 of the first clamping member 1 and the second clamping member 2 towards one another in direction D1 such that the first clamping member 1 and the second clamping member 2 move about the connector 3 as shown in FIG. 1B such that the top portions 9 move apart from one another. The first clamping member 1 and second clamping member 2 are moveable to the closed clamping position by releasing the bottom portions 8 of the first clamping member 1 and the second clamping member 2. The connector 3 has a hole 7 that extends through the connector 3. The hole 7 may be configured to receive items perpendicular to the connector. The hook 4 may be disposed through the hole 7. The hook 4 may have a stopper 6 that secures the hook 4 in the hole 7 such that the hook 4 is suspended from the connector 3. The hook 4 may be rotatable within the hole 7 and may be rotatable 360-degrees within the hole. The hook 4 may extend from the connector 3 such that the securable attachment portion 12 is located between the first clamping member 1 and the second clamping member 2. The hook 4 may extend a further distance from the connector 3 such that the securable attachment portion 12 extends past the bottom portions 8 of the first clamping member 1 and the second clamping member 2.

Attachment Portion

Figure 2:
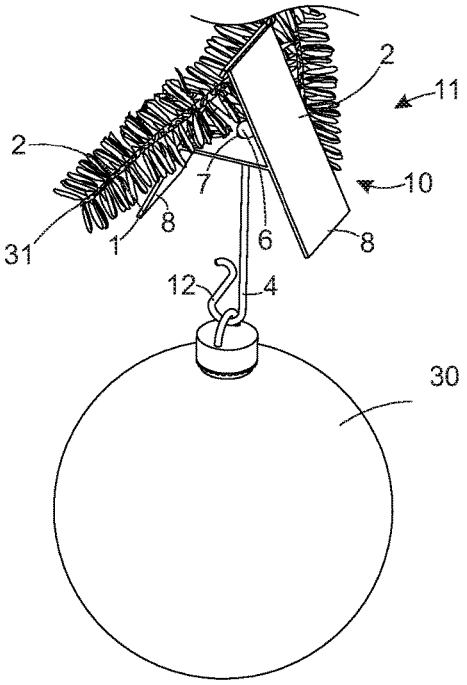
FIG. 2 depicts a perspective view of an ornament display hanger hanging from a tree branch with an ornament hanging from the ornament display hanger.
Figure 7:
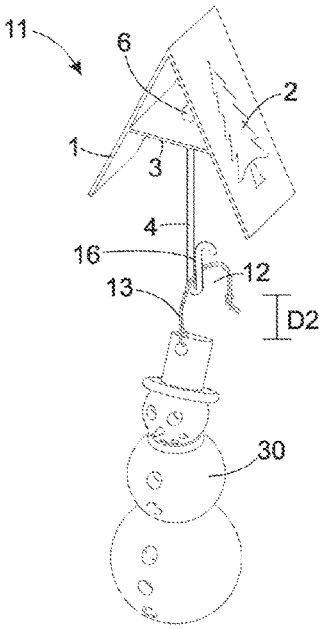
FIG. 7 depicts a perspective view of an ornament display hanger and an ornament hanging therefrom according to one embodiment.
Figure 8:
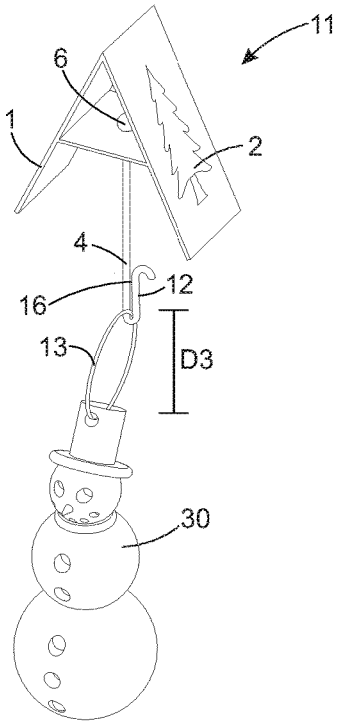
FIG. 8 depicts a perspective view of an ornament display hanger and an ornament hanging therefrom according to one embodiment.
Figure 15A:
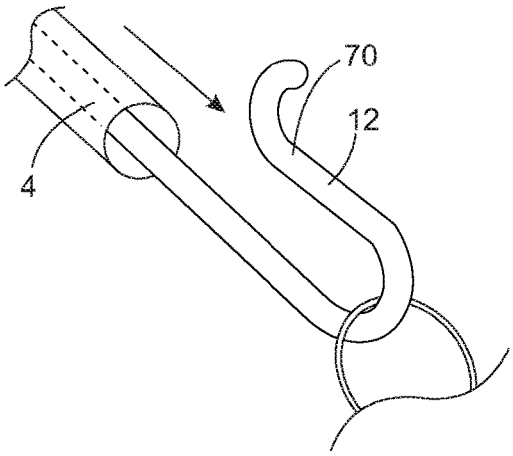
FIG. 15A depicts a partial view of a hook of an ornament display hanger according to one embodiment.
Figure 15B:
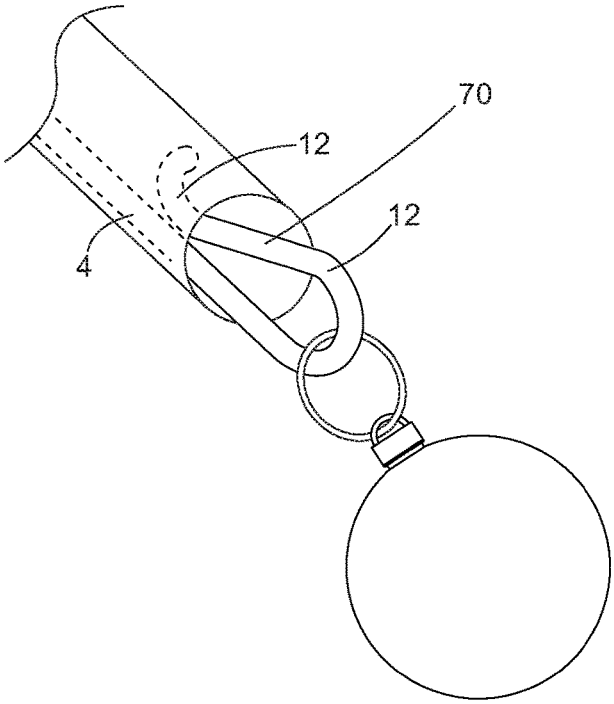
FIG. 15B depicts a partial view of the hook of the ornament display hanger according to the embodiment shown in FIG. 15A with an ornament secured thereto.

The securable attachment portion 12 may be configured to receive an ornament 30 having a ring, hole, or other opening configured to receive a hook or other hanger. The securable attachment portion 12 may also be configured to receive a string, ribbon, or other loop of an ornament 30 or decoration. In the embodiment shown in FIGS. 1A and 1B, the securable attachment portion is a portion of the hook 4 that curves back on itself forming a hook shape. The securable attachment portion 12 is not limited to having this shape. For example, as shown in FIGS. 7 and 8 (discussed hereinafter), the securable attachment portion may be a portion of the hook 4 having a curve that provides a slit 16 into which a string loop or ribbon loop or other hanging mechanism of an ornament or decoration can be securably inserted. In another embodiment, the securable attachment portion 12 may comprise a flexible hook 70. For example, with reference to FIGS. 15*a* and 15*b*, an embodiment is shown in which the hook 4 comprises a tube 74, and the securable attachment portion 12 comprises a flexible hook 70 that is retractable into the tube 74, for example, by a spring, or elastic material within the tube 74 that is attached to the flexible hook 70. As shown in FIG. 15A, the flexible hook 70 may be pulled in direction D3 out of the tube 74 such that an ornament 30 can be attached to the flexible hook 70. As shown in FIG. 15B, the ornament 30 is securable to the securable attachment portion 12 by releasing the flexible hook 70 such that the flexible hook 70 retracts into the tube 74. attachment portion attachment portion attachment portion attachment portion attachment portion attachment portion Referring now to FIG. 2, a perspective view of an ornament display hanger 11 is shown hanging from a tree branch with an ornament 30 hanging from the hook 4 of the ornament display hanger 11. The clip 11 may be hung from the tree branch 31 at any location on the tree branch 31 without having to manipulate the clip 11 over the tip 32 of the branch 31 and over the needles of the tree branch 31 to the desired location of the branch 31. It should be understood that the ornament display hanger 11 is not limited to hanging holiday ornaments, and could hang any type of decoration, such as a banner, a photo, a balloon, jewelry, tinsel, toys, and the like. Further, it should be understood that the ornament display hanger 11 is not limited to being hung on a tree branch, and could be hung in any location, such as from a wall hanging, a door handle, a bulletin board, a lamp shade, a rearview mirror, a clothesline, a handrail, and the like.

Rotation of the hook 4 within the hole 7 may permit the ornament 30 to rotate in either a clockwise or counterclockwise direction, or both. The rotation of the hook 4, which causes the rotation of an ornament 30 hung on the hook 4, may be caused by physical rotation of the hook 4 or ornament 30 by a user, or by vibrations or movement that cause the hook 4 and ornament 30 to move without physical manipulation of the hook 4 or ornament 30 by the user. As another example, an ornament display hanger 11 may be configured to execute a movement pattern of an ornament 30 hanging on the hook 4. For example, an ornament display hanger 11 may have a motorized spinning mechanism that rotates the hook 4 in the hole 7 at a single rate of rotation for any period of time, or at different rates of rotation for any period of time. A motorized spinning mechanism may be powered by a battery, electricity, may be solar powered, or other power source. The ornament display hanger may comprise an integrated circuit, a processor, a power source, and a receiver configured to produce movement by the ornament display hanger 11. The receiver may be configured to receive signals via radiofrequency (RF), cell waves, wireless internet connection, and the like.

A movement pattern may be customizable by a user. For example, an ornament display hanger 11 may be wirelessly pairable to a control device such as a mobile device, for example, a tablet or cell phone; a remote control; computer, and the like, for example via Bluetooth®, and a user may be able to open a program such as an application that allows a user to wirelessly program a customized movement pattern for the ornament display hanger 11 to execute. For example, a user may program the ornament display hanger 11 to rotate an ornament twice clockwise and then three times counterclockwise, or other combination of movements. An ornament display hanger 11 may be configured to play a prerecorded piece of music or make a sound. For example, an ornament display hanger 11 may be configured to make nature sounds such as bird calls or sounds of forest animals. Other sounds are contemplated such as bells, chimes, or other tonalities. Music and sounds produced by an ornament display hanger 11 may similarly be wirelessly programmable by a user.

Figure 3:
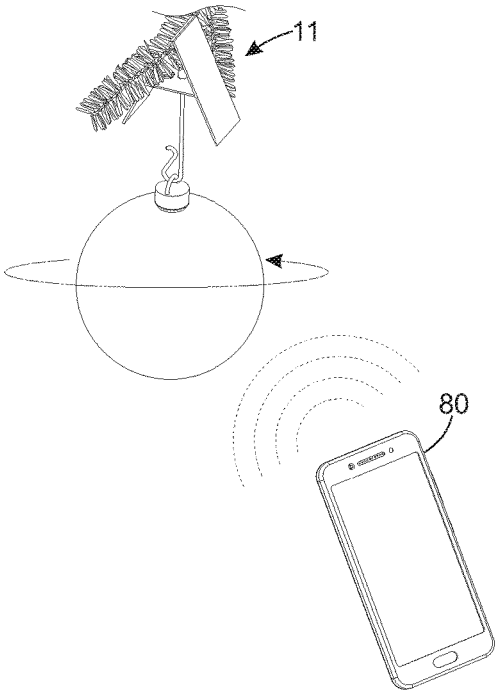
FIG. 3 depicts a perspective view of a control device being used to control an ornament display hanger according to one embodiment.

As yet another example, multiple ornament display hangers 11 may be purchased together, for example, in a kit. Multiple ornament display hangers 11 may be purchased individually, and be configured to connect to one another. Multiple ornament display hangers 11 may be configured, by a wire that connects each of the ornament display hangers 11 to one another, or wireless connection such as Bluetooth®, to rotate ornaments 30 hanging from the multiple ornament display hangers 11 in unison, separately in a pattern, or other configuration. As shown in FIG. 3, a single ornament display hanger 11 or multiple ornament display hangers 11 may be configured to wirelessly pair with a mobile device 80 such as a cell phone or tablet, or with a computer such that a user can program a desired pattern of rotation or movement of ornaments displayed on an ornament display hanger 11 or multiple ornament display hangers 11.

Figure 16:
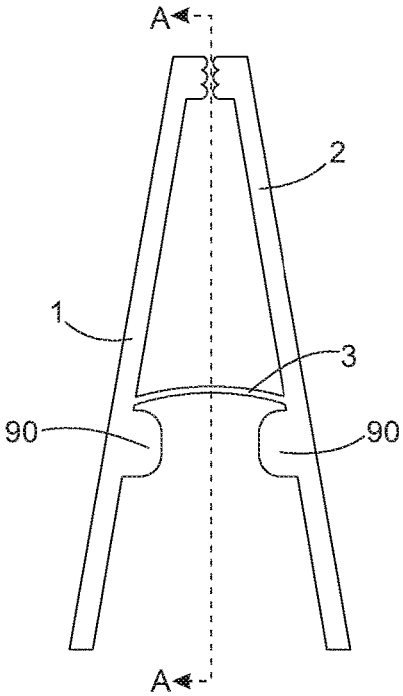
FIG. 16 depicts a front view of an ornament display hanger according to one embodiment.
Figure 17:
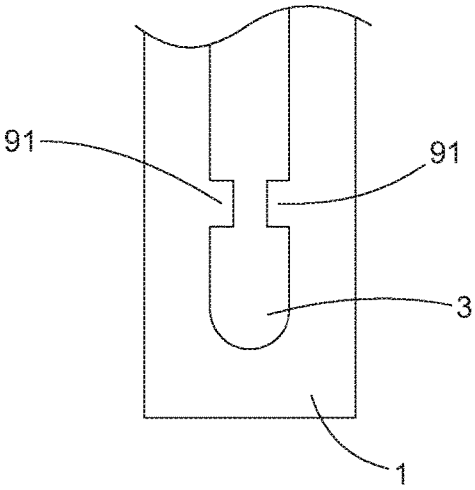
FIG. 17 depicts a cross sectional side view of the ornament display hanger of FIG. 16 taken along line A-A according to one embodiment.
Figure 20A:
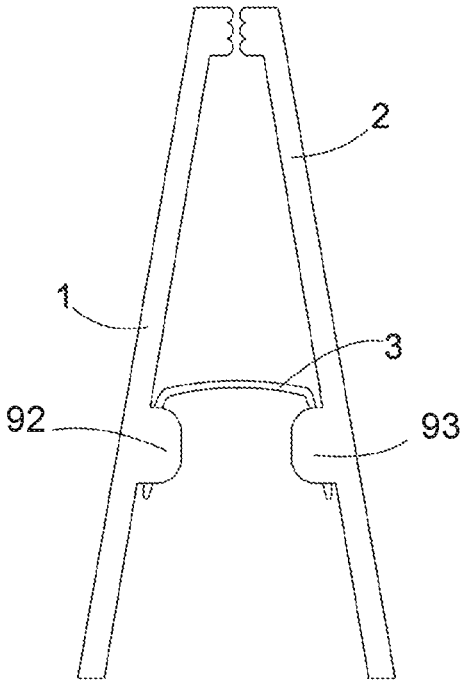
FIG. 20A depicts a side view of an ornament display hanger according to one embodiment.
Figure 20B:
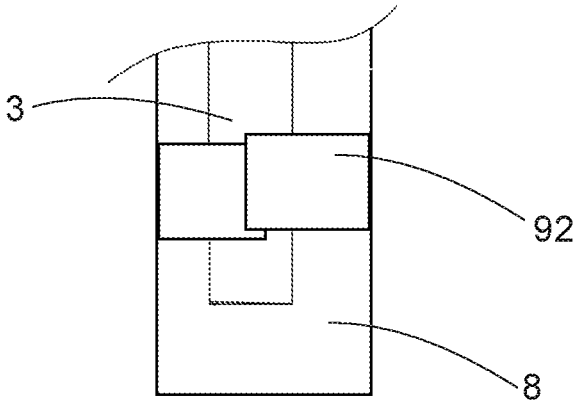
FIG. 20B depicts a partial view of a clamping member of the ornament display hanger of FIG. 20A according to one embodiment.

The ornament display hanger 11 may be made of plastic, cardboard, metal, wood, balsa wood, wicker, and the like. The first clamping member 1 and the second clamping member 2 and the connector 3 may be a continuous piece of material. For example, the first clamping member 1 and the second clamping member 2 and the connector 3 may be made of a continuous piece of plastic having a flexibility that permits the connector 3 to facilitate opening of the clamp 10 when the first clamping member 1 and the second clamping member 2 are pressed together at the bottoms 8. The connector 3 may be straight, flat, "U" shaped, "C" shaped, curved, or have another shape. As shown in FIG. 16, in one embodiment, the connector 3 is secured in place between the first clamping member 1 and second clamping member 2 by two protrusions 90 located on the inside of the first and second clamping members 1, 2. The protrusions 90 may be rounded, flat, mushroom-shaped, and the like. The protrusions may have ridges that engage with the connector 3. The connector 3 may also be secured to the first and second clamping members 1, 2 by one or more tabs. For example, shown in FIG. 17 is a cross section side view taken along line A-A of the inside of the first clamping member 1 of FIG. 16. In this embodiment, the connector 3 is curved and each end of the connector is secured to a connector by being inserted into tabs 91 such that the tabs 91 hold the connector 3 against the clamping members 1, 2. The connector 3 may be secured to the clamping members 1, 2 by being inserted into a slit, hole, ring, bore, and the like disposed on the clamping members 1, 2, for example, where the tabs 91 are shown in FIG. 17. With reference to FIG. 20A, in another embodiment, the connector 3 has a "C" shape and each end of the "C" shape of the connector inserts into a hole of a protrusion 92, 93 of the first and second clamping members 1, 2. The holes of the protrusions 92, 93 may be slits, bores, rings, and the like. With reference to FIG. 20B, a cutoff side view of the first clamping member 1 of the clamp 11 of the ornament display hanger 10 of FIG. 20A is shown according to an embodiment in which the protrusions 92, 93 each comprise two tabs that are foldable around an end of the "C" shape of the connector 3. The ends of the "C" shape of the connector inserted into the protrusions 92, 93 may be configured to provide the clamping force of the top portions 9 of the first clamping member 1 and second clamping member 2 when the clamp 11 is in a closed position.

Figure 4A:
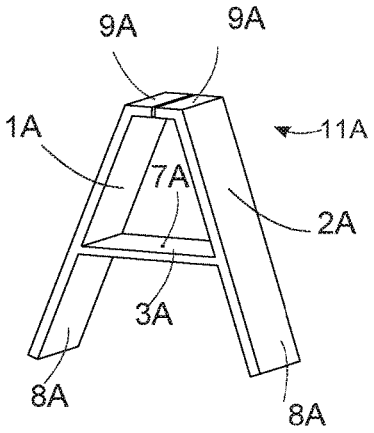
FIG. 4A depicts a perspective view of an ornament display hanger according to one embodiment
Figure 4B:
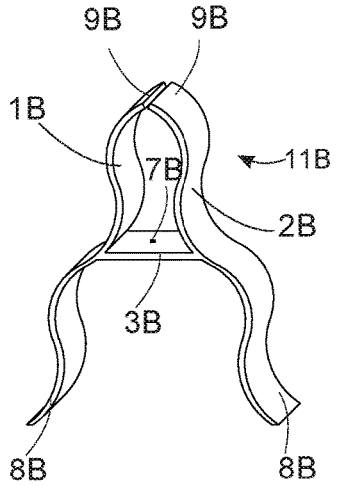
FIG. 4B depicts a perspective view of an ornament display hanger according to one embodiment.
Figure 4C:
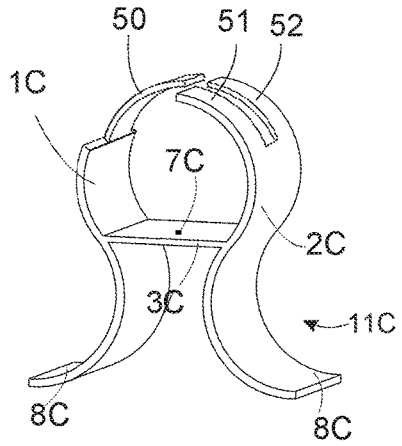
FIG. 4C depicts a perspective view of an ornament display hanger according to one embodiment.
Figure 18:
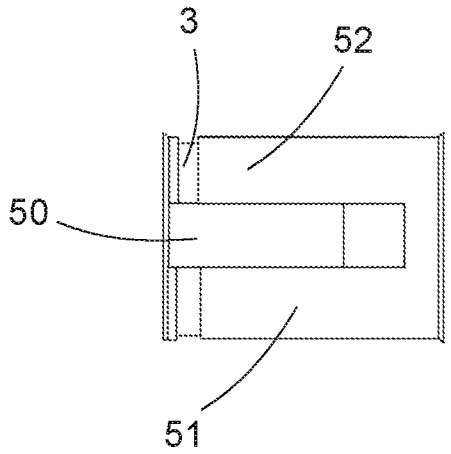
FIG. 18 depicts a top view of the ornament display hanger of FIG. 4C.
Figure 19:
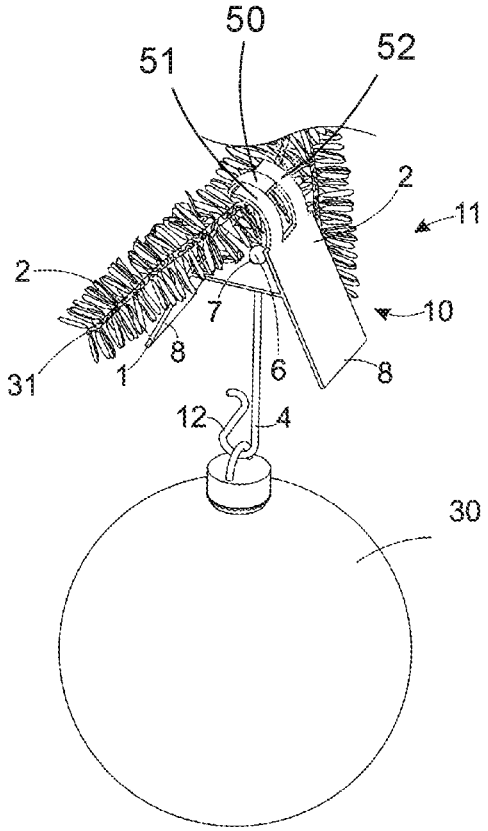
FIG. 19 depicts a perspective of an ornament display hanger hanging from a tree branch according to one embodiment.

The first clamping member 1 and the second clamping member 2 are not limited to being straight or flat, and may have a different shape. For example, as shown in FIGS. 4A, 4B, and 4C, clamping member 1 and clamping member 2 may have a square shape, be curved in shape, or have a wavy shape. As an example, as shown in FIG. 4A, the first and second clamping members 1A, 2A may have a straight shape. As shown in FIG. 4B, the first and second clamping members 1B, 2B may have wavy shapes. As shown in FIG. 4C, the first and second clamping members 1C, 2C may have a curved shape. The first clamping member 1 and the second clamping member 2 are not limited to having matching top portions 9. The top portions 9 of the first clamping member 1 and second clamping member 2 may have protruding portions that interlock. With reference to FIG. 4C, an embodiment is shown in which the top portion 9 of the first clamping member 1 has a first protrusion 50, and the top portion 9 of the second clamping member 2 has a second protrusion 51 and a third protrusion 53. The first, second, and third protrusions 50, 51, 52 may be tines, prongs, projections, teeth, protuberances, extensions, points, or the like. In this embodiment, in a closed clamping position, the first, second, and third protrusions 50, 51, 52 may be configured to engage in an interlocking fit in which the first protrusion 50 fits between the second and third protrusions 51, 52. In another embodiment, in a closed clamping position, the tip of the first protrusion 50 may meet the tips of the second and third protrusions 51, 52. With reference to FIG. 18, a top view of the embodiment of the ornament display hanger 11C of FIG. 4C is shown. The ornament display hanger 11C is shown in a closed clamping position in which the first protrusion 50 is between the second and third protrusions 51, 52. With reference to FIG. 19, a perspective view of an ornament display hanger hanging from a tree branch according to one embodiment is shown. In this embodiment, the top portions 9 include first, second, and third protrusions 50, 51, 52 that interlock when the clamp 11 is in a closed position. The first, second, and third protrusions 50, 51, 52 are secured around the tree branch. The space between the second protrusion 51 and third protrusion 52 is configured to receive the first protrusion 50, and may also receive needles of the tree branch, which permits the ornament display hanger 11 to fit closely and securely to the tree branch without deforming the needles.

Figure 5:
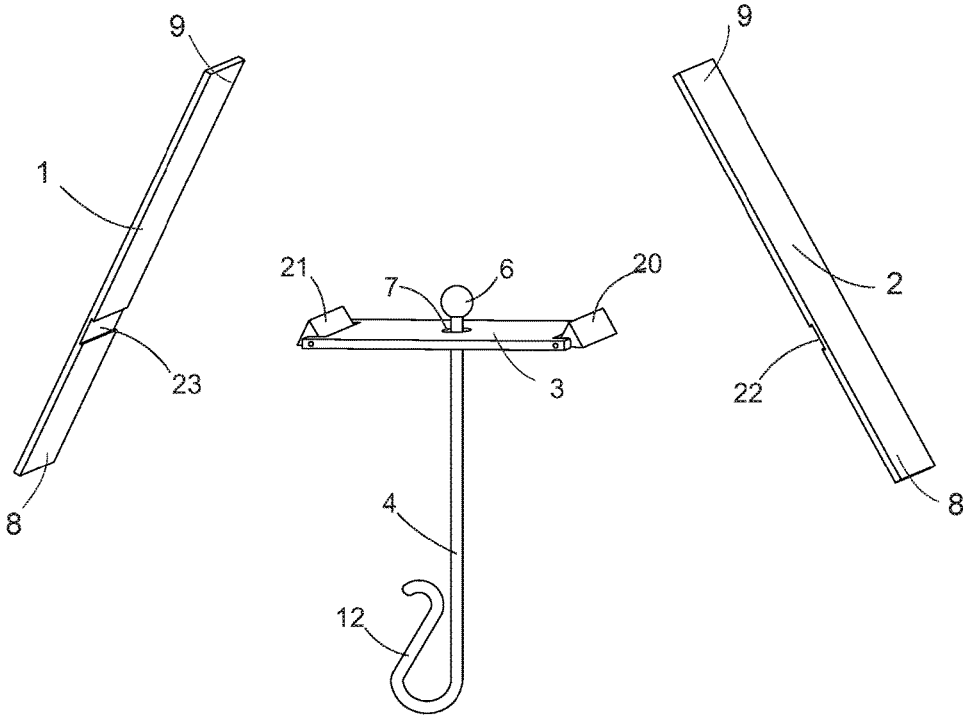
FIG. 5 depicts an exploded view of components of an ornament display hanger according to one embodiment.

The first clamping member 1, the second clamping member 2, and the connector 3 may each be an individual separate piece of material. The first clamping member 1 and second clamping member 2 may be attached to the connector 3 by glue, adhesive, a hinge, joint, pin, swivel, ball and socket, or the like. As another example, the first clamping member 1 and the second clamping member 2 may be made of the same material and the connector 3 may be made of a different material. For example, the first clamping member 1 and the second clamping member 2 may be made out of a rigid material, and the connector 3 may be made out of a more flexible material. With reference to FIG. 5, an exploded view of an additional embodiment of the ornament display hanger 11 is shown. In this embodiment, the connector 3 has a first flexible tab 20 and a second flexible tab 21 that are configured to slide into a first notch 22 in the first clamping member 1 and a second notch 23 in the second clamping member 2, respectively. The first notch 22 and the second notch 23 may have a cross section that is the same shape as the cross section of the first flexible tab 20 and the second flexible tab 21, respectively, such that the connector 3 can be securably affixed to the first clamping member 1 and the second clamping member 2. The first flexible tab 20 and the second flexible tab 21 may be configured such that the first flexible tab 20 and the second flexible tab 21 place the top portions of the first clamping member 1 and second clamping member 2 in a default closed clamping position when the first clamping member 1 and the second clamping member 2 are affixed to the connector 3 by sliding the first flexible tab 20 into the first notch 22 and the second flexible tab 21 into the second notch 23.

The ornament display hanger 11 may be made of a transparent material, for example, a material through which light can pass. This may allow string lights or other illuminated decorations to shine through the ornament display hanger, thereby enhancing the decoration. The ornament display hanger 11 may be made out of a decorative material; for example, the ornament display hanger may have a glitter, sparkle, or reflective surface. This may be accomplished by any process, such as applying a decorative layer to the ornament display hanger 11, or making the ornament display hanger out of materials that have decorative properties such as colored plastic, a reflective gold, silver, copper, or other metal, or treated wood or the like. The first clamping member 1 and the second clamping member 2 may each have a transparent sleeve into which a photo or decorative image can be inserted. As another example, the first clamping member 1 and second clamping member may have a decorative shape like a bow, star, candy-cane, or the like. As yet another example, the first clamping member 1 and the second clamping member 2 may be configured to receive a decoration. As an example, the first clamping member 1 and second clamping member 2 may have one or more holes or slits configured to receive protrusions, tabs, or the like of attachable decorations.

Figure 6:
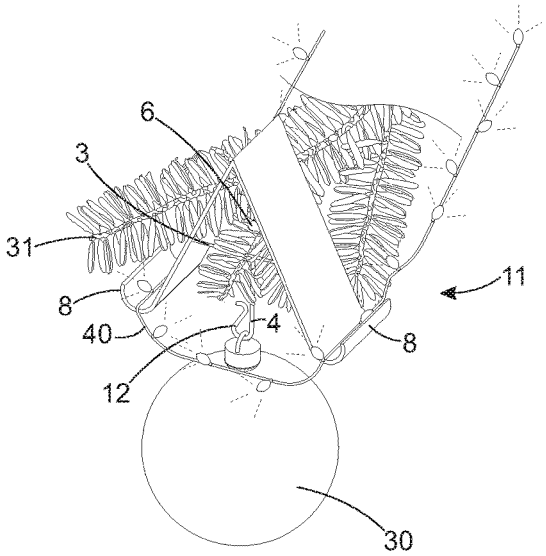
FIG. 6 depicts a perspective view of an ornament display hanger hanging from a tree branch with a string of lights secured to the ornament display hanger according to one embodiment.

With reference to FIG. 6, a perspective view of an ornament display hanger according to another embodiment is shown. In this embodiment, the bottoms 8 of the first clamping member 1 and the second clamping member 2 may have a rounded curve that is configured to receive additional decorative items on a tree branch. For example, a portion of a string of lights 40 may rest in the rounded curve of a bottom 8, permitting a user to hang the string of lights 40 in a particular position on the tree, and permitting a user to position a certain light positioned closer to a specific ornament for more customized decorating. In another embodiment, the ornament display hanger 11 may have lights attached thereto, for example, battery operated LED lights. LED lights on the ornament display hanger may be configured to communicate with a portable device such as a tablet or cell phone such that a user can choose a color, brightness, or pattern of light produced by the LED lights. For example, the communication may be made by Bluetooth® or RF signals. The LED lights may be configured to be programmed by a control device such as a tablet or cell phone, remote control, or computer. For example, different patterns or colors of the lights may be customized to accompany a song. Lights attached to the ornament display hanger 11 may be battery operated, solar powered, or configured to be integrated into a separate string of lights. Lights may be attached to the ornament display hanger by a fastener, button, glue, adhesive, and the like. The bottoms 8 are not limited to having a rounded curve. For example, the bottoms 8 may have a perpendicular ridge on which a string of lights could rest or be secured by.

Referring now to FIG. 7, a perspective view of an ornament display hanger 11 and an ornament 30 hanging on the ornament display hanger 11 according to an embodiment is shown. In this embodiment, the ornament 30 has a string loop 13 configured to hang the ornament 30 on a tree branch. The securable attachment portion 12 has a slit 16 configured to receive the string loop 13. The slit 16 is formed from a portion of the hook 4 that is folded back on itself. The hook 4 is not limited to having a securable attachment portion 12 that is a portion of the hook 4 that curves back on itself. For example, the hook 4 may have a securable attachment portion 12 that is a clip. As another example the securable attachment portion 13 may be a bendable material that can be shaped by a user into any shape such as a wire, a wax-covered string or the like. The slit 16 may also be formed from a cut or slice made into the hook 4, a separate piece fastened or attached to the hook 4, or the like. The string loop 13 may be attached to the ornament display hanger 11 by placing the string loop 13 into the slit 16 of the securable attachment portion 12. The slit 16 is configured to secure an ornament hanger such as string loop 13 by pressing the ornament hanger into the slit 16 such that the portion of the hook 4 that is folded back on itself clamps, pinches, or presses the ornament hanger, such as string loop 13. The slit 16 of the securable attachment portion 12 may be configured to receive a hanger of a decoration or ornament at multiple distances away from the connector 3. For example, any portion of the string loop 13 of the ornament 30 may be secured to the securable attachment portion 12, such that a user can choose the height at which the ornament 30 hangs from the ornament display hanger 11. For example, as shown in FIG. 7 a user may secure the string loop 13 in the slit 16 of the securable attachment portion 12 close to the ornament 30, so that the ornament 30 hangs a distance D2 from the connector 3 of the ornament display hanger 11 connector. As another example, as shown in FIG. 8, a user may secure the string loop 13 near the end of the string loop 13 such that the ornament hangs a distance D3 that is shorter than distance D2 from the connector 3 of the ornament display hanger 11 connector. The user may hang an ornament 30 at different distances from the ornament display hook 11, such as from the connector 3 without making alterations to the string loop 13 or other hanging mechanism of the ornament, such as cutting the string loop 13 to make it shorter or adding string to the string loop 13 to make it longer, or untying the string loop 13 and re-tie the string loop 13 such that the string loop 13 has a shorter loop.

Figure 9A:
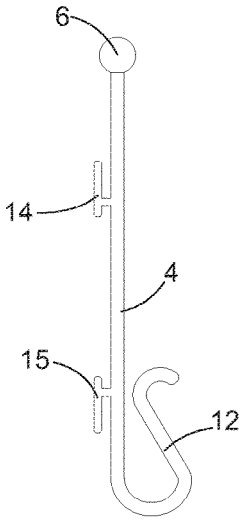
FIG. 9A depicts a perspective view of a hook of an ornament display hanger according to one embodiment.
Figure 9B:
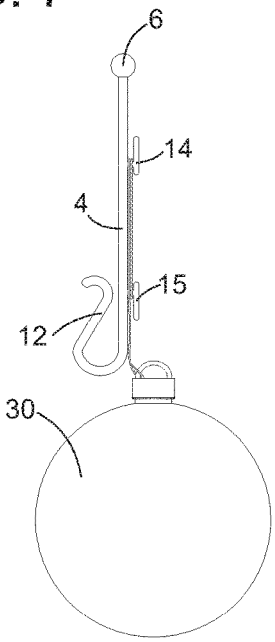
FIG. 9B depicts a perspective view of the hook of an ornament display hanger according to the embodiment shown in FIG. 9*b* with an ornament hanging therefrom.

Referring to FIG. 9A, a perspective view of a hook of an ornament display hanger according to an embodiment is shown. In this embodiment, the hook 4 may have a first prong 14 and a second prong 15 located along a length 100 of a hook body of the hook that protrude from the hook 4 in opposite directions. The hook 4 may have a first prong 14 and a second prong 15 instead of, or in addition to a securable attachment portion 12. With reference to FIG. 9B, a perspective view of the hook 4 of the ornament display hanger 11 of FIG. 9A with an ornament hanging therefrom. As shown in FIG. 9B, a string loop 13 of the ornament 30 can be wrapped around the first prong 14 and second prong 15. The first prong 14 or the second prong 15 or both may be movable along the hook 4 such that the distance between the first prong 14 and the second prong 15 can be adjusted. This may facilitate hanging ornaments 30 with different length string loops on the hook 4.

Figure 10:
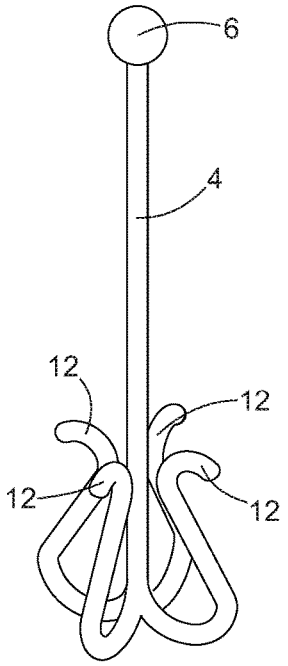
FIG. 10 depicts a perspective view of a hook of an ornament display hanger according to one embodiment.

The hook 4 may have multiple securable attachment portion s 12 where an ornament 30 or multiple ornaments 30 can be hung. With reference to FIG. 10, a cutoff view of a connector 3 and hook 4 of an ornament display hanger 11 according to another embodiment is shown. In this embodiment, the hook 4 has multiple securable attachment portion s 12. The multiple securable attachment portion s 12 are configured to hang multiple ornaments 30 proximate to one another on a tree branch. The rotation of the hook 4 in this embodiment may be advantageous where a user has multiple ornaments that look aesthetically pleasing together. Multiple ornaments 30 may hang together and rotate in a decorative display.

Figure 11A:
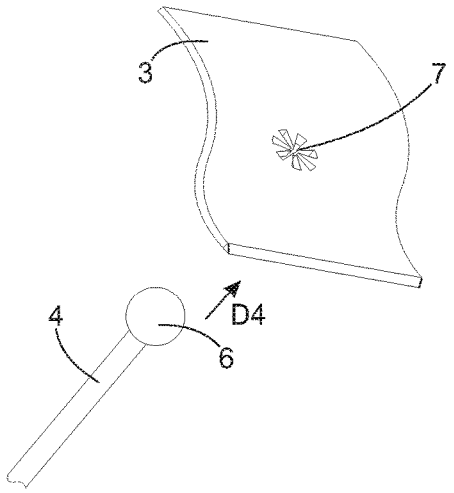
FIG. 11A depicts a cutoff view of a connector and hook of an ornament display hanger according to one embodiment.
Figure 11B:
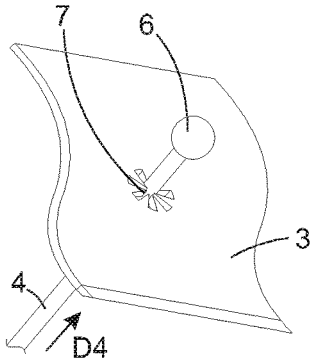
FIG. 11B depicts a cutoff view of the connector and hook of an ornament display hanger according to the embodiment shown in FIG. 11A interacting with one another according to one embodiment.

The hole 7 and the hook 4 of an ornament display hanger 11 may be configured such that the hook 4 is removable from the hole 7 such that the user is able to attach an ornament or decoration to the hook 4 and then affix the hook 4 to the ornament display hanger 11. As an example, the hook 4 may comprise a cap, stopper, nub, or other attachment that is larger than the hole 7 such that the hook 4 is removable from the hole 7 by removing the stopper 6 from the hook 4 and pulling the hook 4 out of the hole 7. For example, the stopper 6 may removably screw onto the hook 4. As another example, the stopper 6 may be configured to have a securable friction fit when the stopper 6 is pressed onto the hook 4. For example, the stopper 6 may be made of a material having a higher friction than the material of the hook. For example, the stopper 6 may be made of rubber and the hook 4 may be made of a plastic. It should be understood that the hook 4 is not limited to being removable from the hole 7 by the stopper 6. With reference to FIG. 11A, a cutoff view of a connector 3 and hook 4 of an ornament display hanger 11 according to an embodiment. In this embodiment, the hole 7 is made of an asterisk-shaped slit in the connector 3. The stopper 6 is insertable into the hole 7 by pressing the stopper 6 through the asterisk shaped slit, such that the hole 7 closes around the hook 4, as shown in FIG. 11B. The stopper 6 is configured to prevent the hook 4 from coming out of the hole 7 unless the stopper is pulled with force through the asterisk shaped slit of the hole 7. The hole 7 may have any shaped slit. The hole 7 may be a circular or other shaped hole. As a further example, the hole 7 may be rigid, and the stopper 6 may be of a flexible material such as rubber, such that the stopper 6 may be pressed through the rigid hole 7. The stopper 6 is not limited to being spherical in shape and could be any shape, such as a cone, a cube, a cylinder, or the like. It may be advantageous for the stopper 6 to be narrower at the top of the stopper 6 than the bottom of the stopper such that the stopper 6 is more easily pressed through the hole 7. The hole 7 may be reinforced, for example, with an eyelet, grommet, or other rigid material such that multiple insertions of the hook 4 in and out of the hole 7 do not cause wear and tear to the hole 7.

Figure 12:
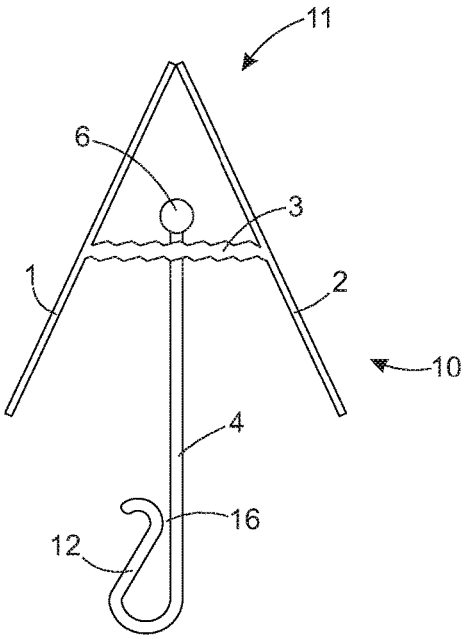
FIG. 12 depicts a front view of an ornament display hanger according to one embodiment.

The connector 3 is not limited to having one hole 7. The connector 3 may have multiple holes 7, and a hook 4 may be disposed through each of the multiple holes 7. The hooks 4 hanging from the multiple holes 7 may have different lengths such that multiple ornaments can be hung near one another from the same ornament display hanger 11. This may be advantageous for hanging ornaments 30 with a particular familial importance, or similarly designed ornaments, together, thereby increasing a user's ability to customize their decoration. The connector 3 is not limited to being flat. With reference to FIG. 12, a front view of an embodiment of an ornament display hanger 30 is shown in which the connector 3 has an accordion or zig-zag shape. The accordion shape of the connector 3 is configured to facilitate the opening and closing of the clamp 11 by contracting the connector 3 when the bottoms 8 of the first clamping member 1 and the second clamping member 2 are pressed together, and expanding the connector 3 when the bottoms 8 of the first clamping member 1 and the second clamping member 2 are released. As another example, the connector 3 may be a telescoping or spring-loaded member.

Figure 13:
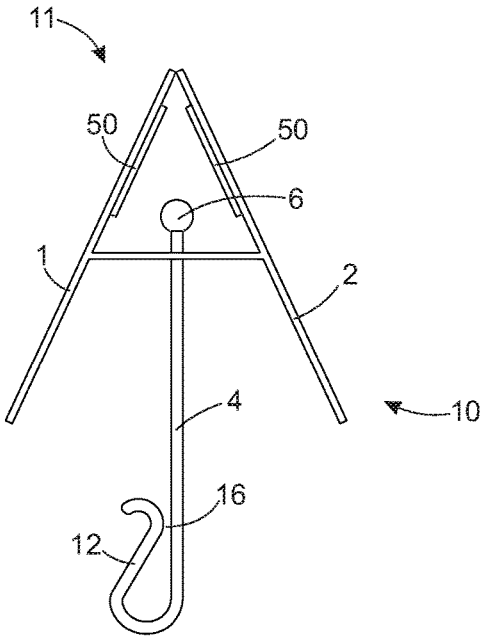
FIG. 13 depicts a front view of an ornament display hanger according to one embodiment.

With reference to FIG. 13, a front view of an ornament display hanger according to another embodiment is shown. In this embodiment, the ornament display hanger 11 is configured to produce movement of an ornament, for example, side to side movement. In this embodiment, the stopper 6 is made out of a magnetic material, and each of the first clamping member 1 and the second clamping member 2 include a magnet 50 affixed thereto such that a magnet 50 is on either side of the stopper 6 when the hook 4 is attached to the connector 3. The magnets 50 on the first clamping member 1 and the second clamping member 2 may have the same polarity, and the stopper 6 may have the same polarity as the magnets 50 such that the stopper 6 is repelled back and forth between the magnets 50. The opposing magnetic forces of the magnets 50 and the stopper 6 are configured to produce movement of the stopper 6 between the magnets 50 thereby causing the hook 4 to move back and forth. The back and forth movement of the hook is configured to produce movement of the ornament 30 back and forth.

Figure 14A:
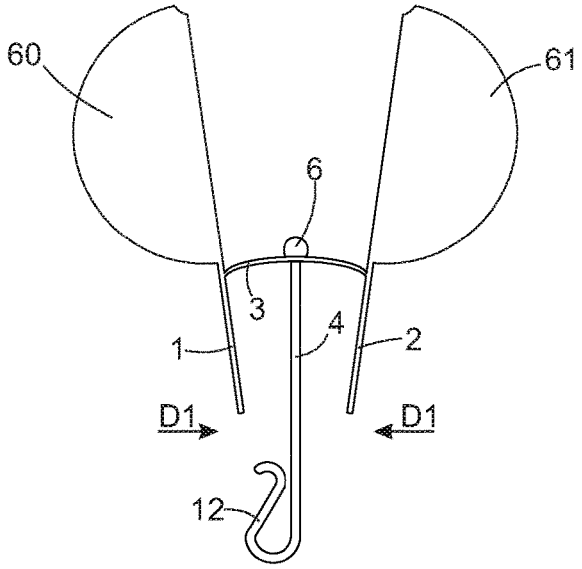
FIG. 14A depicts a front view of an ornament display hanger according to one embodiment.
Figure 14B:
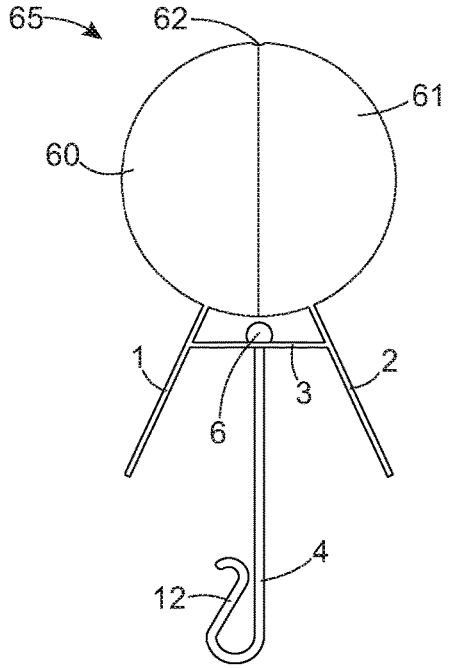
FIG. 14B depicts a front view of the ornament display hanger according to the embodiment shown in FIG. 14A, wherein the ornament display hanger is in an open position.
Figure 14C:
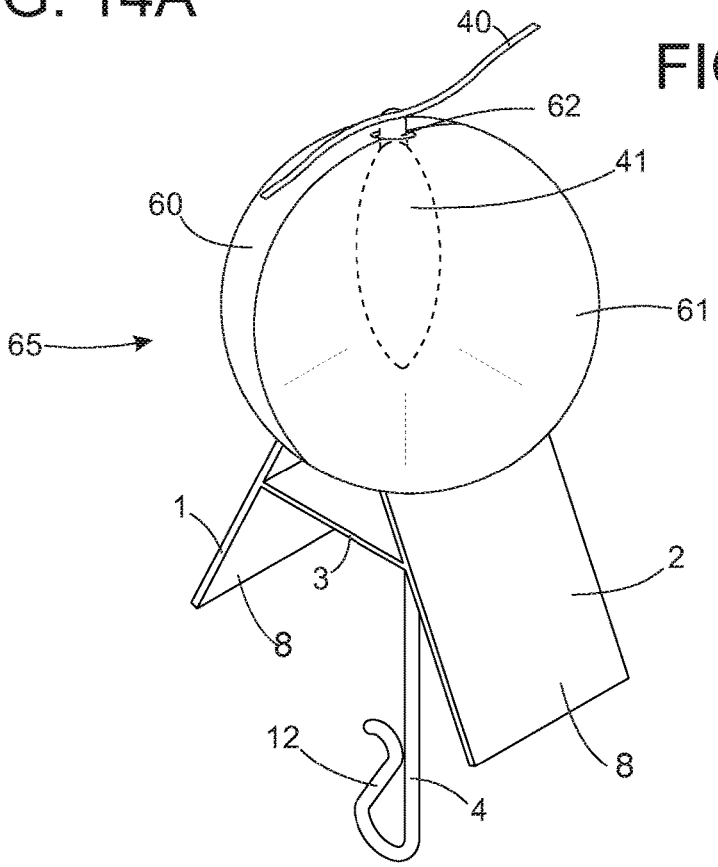
FIG. 14C depicts a perspective view of an ornament display hanger according to one embodiment hanging from a light bulb.

Referring to FIGS. 14A, 14B, and 14C, another embodiment of an ornament display hanger 11 is shown. In this embodiment, the ornament display hanger 11 includes a light bulb container body 65 that is configured to attach to a light bulb 41, for example, a light bulb on a string of lights 40 such as incandescent or LED lights. In this embodiment, the first clamping member 1 comprises a first light bulb container body portion 60 located at the top portion 9 of the first clamping member 1 and the second clamping member 2 comprises a second light bulb container body portion 61 located at the top portion 9 of the second clamping member 2. The first and second light bulb container body portions 60, 61 are configured to form the light bulb container body 65 when the clamp 11 is in a closed clamping position. The light bulb container body may have a size that is able to contain a light bulb inside, for example, a mini-light, a C7 light, or a C9 light. The first and second light bulb container body portions 60, 61 are configured such that an opening 62 is provided by the first and second light bulb body container portions 60, 61 when the first and second clamping members 1, 2 are in a closed clamping position, as shown in FIG. 14B. The opening 62 may be formed by a indent, space, notch, or the like in each of the first and second light bulb container body portions. With reference to FIG. 14C, the opening 62 is configured to receive and secure the ornament display hanger 11 to the light bulb 41 such that the light bulb 41 is secured inside the light bulb container body 65 The clamp 11 is configured to be opened, as shown in FIG. 14A, by the bottom portions 8 of the first and second clamping members 1, 2 being pressed toward each other such that the light bulb container body is able to receive a light bulb 41. As shown in FIG. 14C, the clamp 11 is closable around the light 41 of a string of lights 40 such that the light bulb 41 is secured in the opening 62 and located in between the first and second light bulb container body portions 60, 61, The first and second light bulb container body portions 60, 61, may be transparent such that the light emanating from the light bulb 41 can shine through first and second light bulb container body portions 60, 61. In the embodiment shown in FIGS. 14A, 14B, and 14C the first and second light bulb container body portions 60, 61 each have a half-sphere shape, and form a sphere when the clamp 11 is in a closed position. The first and second light bulb container body portions 60, 61 are not limited to making a sphere shape and may create any geometric shape such as a cylinder, a cube, a tetrahedron, a dodecahedron, an icosahedron, and the like. This may be advantageous for directing light emanating from the light 41 in different patterns, brightnesses, and directions. The first and second light bulb container body portions 60, 61 may be made of the same material as the first clamping member and the second clamping member. The first and second light bulb container body portions 60, 61 may be made of a different material than the rest of the first clamping member 1 and the second clamping member 2. For example, the first and second light bulb container body portions 60, 61 may be made of a transparent plastic and the rest of the first and second clamping members 1, 2 may be made out of an opaque plastic or metal. The first and second light bulb container body portions 60, 61 may be configured to direct light emanating from the light bulb 41 in the direction of an ornament 30 hanging on the hook 4.

The ornament display hanger 11 may be sold as a kit. For example, an ornament display hanger 11 kit may comprise a first clamping member 1, a second clamping member 2, a connector 3 that is configured to securably engage with the first clamping member 1 and the second clamping member 2, a hook 4, and a stopper. The ornament display hanger 11 kit may comprise multiple ornament display hangers 11, for example, a set of ten ornament display hangers 11. A kit having multiple ornament display hangers 11 may comprise multiple ornament display hangers 11 that are pre-assembled, or comprise the individual components of multiple ornament display hangers 11 such that a user can assemble the ornament display hangers 11 themselves. As an example, a kit having multiple ornament display hangers 11 may include enough pieces to create 10 ornament display hangers according to any of the embodiments described herein. The pieces may be different materials, different colors, or different shapes, such that a user can customize the ornament display hangers 11 that can be assembled from the kit. An ornament display kit may include materials that can be used to decorate and customize the ornament display hangers such as glue, markers, paint, stickers, and the like.

Figure 21:
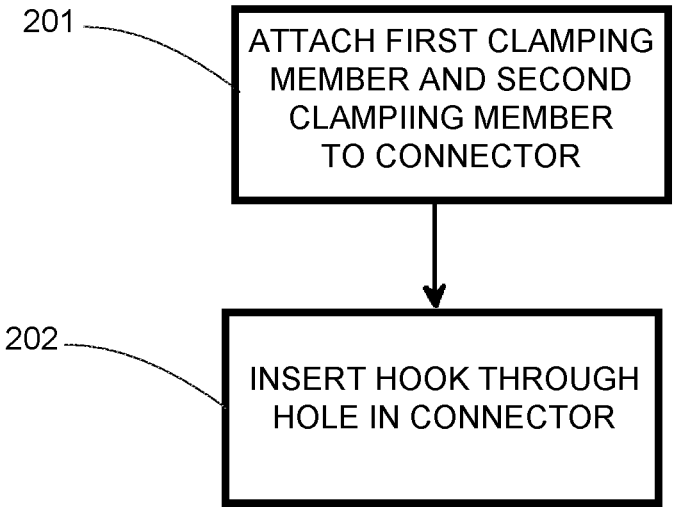
FIG. 21 depicts a flowchart depicting a method for making an ornament display hanger according to one embodiment.

With reference to FIG. 21, a method of making an ornament display hanger, for example, ornament display hanger 11, may include a step 201 of attaching a first clamping member such as first clamping member 1, and a second clamping member, such as second clamping member 2, to a connector such as connector 3, such that the connector is located between the first clamping member and second clamping member and such that the first clamping member and second clamping member are moveable about the connector such that in a first closed position the first top portion and second top portion provide a clamping force, and such that in a second position the first bottom portion and second bottom portion are separated by the first bottom portion and second bottom portion being pressed towards each other. The method may further include a step 202 of inserting a hook through a hole in the connector such that the hook is rotatable 360 degrees within the hole.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An ornament display hanger comprising:

a clamp including:

a first clamping member having a first top portion and a first bottom portion;

a second clamping member having a second top portion and a second bottom portion; and a connector attached to the first clamping member and second clamping member such that the connector is located between the first clamping member and second clamping member, the connector including at least one hole extending through the connector, wherein the first clamping member and second clamping member are moveable about the connector such that in a first position the first top portion and second top portion provide a clamping force, and such that in a second position the first bottom portion and second bottom portion are separated by the first bottom portion and second bottom portion being pressed towards each other; and a hook disposed through the at least one hole, wherein the hook includes a securable attachment portion configured to receive a decoration such that the decoration hangs from the hook, wherein the hook is rotatable 360 degrees within the hole such that rotation of the hook rotates the decoration;

wherein the hook comprises a first magnet, and wherein the first clamping member comprises a second magnet and the second clamping member comprises a third magnet, wherein the polarities of the first magnet, second magnet, and third magnet are configured such that the second magnet and third magnet produce movement of the first magnet between the second and third magnet.

2. The ornament display hanger of claim 1, wherein the first top portion includes at least a first protrusion and the second top portion includes at least at least a second protrusion and a third protrusion, wherein, when in the second position, the first protrusion is located in between the second protrusion and third protrusion.

3. The ornament display hanger of claim 1, wherein the securable attachment portion includes a slit configured to secure a decoration to the hook.

4. The ornament display hanger of claim 1, wherein the securable attachment portion includes a plurality of attachment points each configured to secure a decoration to the hook.

5. The ornament display hanger of claim 1, wherein the clamp further comprises at least one battery-operated light.

6. The ornament display hanger of claim 5, wherein the at least one battery-operated light is configured to communicate with a control device such that the control device controls the illumination of the at least one battery-operated light.

7. The ornament display hanger of claim 1, wherein the first bottom portion and second bottom portion each have a curved shape configured to securably receive a string of lights.

8. The ornament display hanger of claim 1, wherein the hook comprises a hook body having a length, wherein the hook further comprises a first prong and a second prong located along the length, wherein the first prong and second prong extend from the hook body in opposite directions.

9. The ornament display hanger of claim 8, wherein at least one of the first prong and second prong is moveable along the length of the hook body.

10. The ornament display hanger of claim 1, wherein at least one of the first bottom portion and second bottom portion has a curved shape configured to securably receive a string of lights.

11. The ornament display hanger of claim 1, wherein the hook further comprises a stopper, wherein the stopper is configured to be pressed through the at least one hole such that the hook is secured to the connector.

12. The ornament display hanger of claim 1, wherein the hook comprises a tube, wherein the securable attachment portion is releasably retractable into the tube, such that when the securable attachment portion is pulled from the tube, the securable attachment portion is configured to receive a decoration, and such that when the decoration is secured to the securable attachment portion by the securable attachment portion retracting into the tube.

13. A method of making an ornament display hanger, the method comprising:

attaching a first clamping member, which includes a first top portion and first bottom portion, and a second clamping member, which includes a second top portion and second bottom portion, to a connector such that the connector is located between the first clamping member and second clamping member and the first clamping member and second clamping member are moveable about the connector such that in a first closed position the first top portion and second top portion provide a clamping force, and such that in a second position the first bottom portion and second bottom portion are separated by the first bottom portion and second bottom portion being pressed towards each other; and inserting a hook through a hole in the connector such that the hook is rotatable 360 degrees within the hole, wherein the hook includes a securable attachment portion confiqured to receive a decoration such that the decoration hanqs from the hook;

wherein the hook comprises a first maqnet, and wherein the first clampinq member comprises a second magnet and the second clamping member comprises a third magnet, wherein the polarities of the first magnet, second magnet, and third maqnet are confiqured such that the second maqnet and third maqnet produce movement of the first magnet between the second and third magnet.

14. An ornament display hanger comprising:

a clamp including:

a first clamping member having a first top portion and a first bottom portion;

a second clamping member having a second top portion and a second bottom portion; and a connector attached to the first clamping member and second clamping member such that the connector is located between the first clamping member and second clamping member, the connector including at least one hole extending through the connector, wherein the first clamping member and second clamping member are moveable about the connector such that in a first position the first top portion and second top portion provide a clamping force, and such that in a second position the first bottom portion and second bottom portion are separated by the first bottom portion and second bottom portion being pressed towards each other; and a hook disposed through the at least one hole, wherein the hook includes a securable attachment portion configured to receive a decoration such that the decoration hangs from the hook, wherein the hook is rotatable 360 degrees within the hole such that rotation of the hook rotates the decoration;

wherein the first clamping member includes a first light bulb container body portion located at the first top portion and the second clamping member includes a second light bulb container body portion located at the second top portion, wherein the first light bulb container portion has a first notch and the second light bulb container portion has a second notch, wherein, in the first position, the first light bulb container body and second light bulb container body form a light bulb container body and the first notch and second notch form an opening in the light bulb container body, wherein the light bulb container body is configured to receive a light bulb such that the light bulb is secured inside the light bulb container body by the opening and fully surrounded by the container body.

* * * * *